US006035646A

United States Patent [19]

Griswold

[11] Patent Number: 6,035,646

[45] Date of Patent: Mar. 14, 2000

[54] LIQUID CRYOGEN WITHDRAWAL DEVICE WITH PUMP

[75] Inventor: Thomas A. Griswold, Ellington, Conn.

[73] Assignee: Brymill Corporation, Vernon, Conn.

[21] Appl. No.: 09/111,078

[22] Filed: Jul. 7, 1998

[51] Int. Cl.[7] ..... F17C 7/02

[52] U.S. Cl. ..... 62/50.1; 62/293; 222/209

[58] Field of Search ..... 62/50.1, 45.1; 222/209

[56] References Cited

U.S. PATENT DOCUMENTS

| | | | |
|---|---|---|---|
| 2,202,079 | 5/1940 | Ayres | 222/209 |
| 2,996,893 | 3/1961 | Goodenough et al. | 62/50.1 |
| 3,323,689 | 6/1967 | Elmore | 222/209 |
| 3,823,718 | 7/1974 | Tromovitch | 222/209 |
| 4,091,634 | 5/1978 | Shepherd | 62/45 |
| 4,622,889 | 11/1986 | Chappell et al. | 222/209 |
| 5,488,831 | 2/1996 | Griswold | 62/48.1 |

*Primary Examiner*—Ronald Capossela
*Attorney, Agent, or Firm*—M. P. William

[57] ABSTRACT

A liquid cryogen withdrawal device includes a plug (14) for insertion into the neck of a cryogen-containing dewar (10) in gas-tight relationship. A withdrawal tube (17) passes through the plug to conduct liquid from the bottom of the dewar through a sintered bronze filter to a container to be filled with cryogen, and a pressure tube (19) fitted with a pump (20). Cryogen is stored in the dewar with a loose fitting cap thereon, with no withdrawal device in the dewar. When liquid is desired to be retrieved from the dewar, the withdrawal device is inserted into the dewar; and the pump is operated to create enough pressure to force a suitable amount of liquid from the dewar. The plug may have a gas pressure relief valve disposed thereon.

9 Claims, 2 Drawing Sheets

LIQUID CRYOGEN WITHDRAWAL DEVICE WITH PUMP

TECHNICAL FIELD

This invention relates to a device having a pump for withdrawing liquefied cryogenic gas, such as nitrogen, from a large dewar, and related method, which essentially doubles the static holding time for cryogenic liquid stored in a dewar.

BACKGROUND ART

As an example for understanding the present invention, liquefied nitrogen, $LN_2$, is typical of cryogens, and is widely used in industry and in health care. In many applications, liquid nitrogen is stored in various sized dewars near the point of use, and smaller amounts are withdrawn from the dewar to be utilized in an apparatus or instrument as needed. An example of use in health care is set forth in U.S. Pat. No. 4,116,199. Examples of the use of small amounts of nitrogen in industry are given in U.S. Pat. No. 5,222,999 and U.S. Pat. No. 5,237,836. In these examples, nitrogen may be stored near an industrial workstation or within a doctors' offices or other treatment facility in a dewar ranging from 5 liters to 50 liters, depending upon the particular application involved. In use, the nitrogen is withdrawn from the storage dewar and placed in the container of a utilization device, such as the examples referred to hereinbefore.

Typically, the liquid cryogen is withdrawn from a storage dewar by means of what is known in the art as a withdrawal device. This constitutes a plug which fits into the top of the dewar in place of the storage plug, and is held tightly in place by means of expansion, or by means of hold-down devices, such as springs, straps, or clamps. Within the plug there is provided a common pressure relief valve, which typically is set to maintain the gas pressure in the dewar no greater than about 4 pounds per square inch.

The device has a long tube which extends downwardly through the plug to the bottom of the dewar. It extends outwardly of the plug and turns to become horizontal, where a gas-tight valve is fitted. Outwardly of the valve, the tube may be bent downwardly somewhat to direct the liquid toward a container to be held near the dewar, and the liquid flows out of the tube through a sintered bronze filter, which softens the flow (much like the aerator on a kitchen faucet). When liquid cryogen is to be withdrawn, the valve is opened; when the container (e.g., of the utilization device) is full, the valve is closed once again. The withdrawal unit remains attached to the dewar, immersed in the cryogen at all times except when the dewar is being refilled.

The principal problem with such a withdrawal device is that the presence of the tube within the liquid inside the storage dewar continuously pumps heat from the atmosphere outside into the liquid, causing it to continuously boil, converting liquid to gas, which escapes through the pressure relief valve. A typical rate of evaporation is over 12 grams per hour (816 grams per liter). The typical 10 liter dewar with the withdrawal device known in the art mounted therein has a static holding time (that is, the time when all 10 liters of cryogen will evaporated simply by sitting in the storage dewar, with no liquid being removed) of approximately 27 days. This means, in use, various amounts of the liquid is wasted, depending on how much is actually used. While nitrogen is extremely inexpensive (compared to other industrial substances and medical modalities), the delivery of a small amount to a doctor's office, or the like, can be unnecessarily expensive, due to the evaporation caused by the withdrawal device.

Another, less significant problem is that should an operator become distracted, such as dropping a device being filled, or otherwise, a withdrawal device known to the prior art can rapidly empty an entire storage dewar so long as the valve is left open.

A solution to this problem is offered by U.S. Pat. No. 5,488,831. This invention is a removable withdrawal device comprised of a plug for insertion into the neck of the dewar. A withdrawal tube, with a passive heat device disposed at the bottom, passes through the plug for retrieval of the liquid. The heat device causes the liquid to boil, which creates pressure to force an amount of liquid up through the withdrawal tube and out through a sintered bronze filter. However this device may not work adequately with large dewars or when the dewar is almost empty. It was also found through testing that the amount of liquid removed at one time was dependent on the amount of brass on the end of the withdrawal tube, as well as the amount of liquid in the dewar. Thus the amount of cryogen that would be removed at one time is not always predictable.

DISCLOSURE OF INVENTION

Objects of the invention include a provision of a withdrawal device for liquid cryogen storage dewars and a method of use which minimizes the wasteful evaporation of the liquefied cryogen, and can be used with large storage dewars, or when a dewar is almost empty.

According to the present invention, a device for withdrawing liquid cryogen from a cryogen storing dewar comprises an open tube, which may be fitted with a sintered bronze filter at a distal, outflow end thereof, the tube being disposed through a plug that will fit in gas-tight relationship within the neck of the storage dewar. A pressure tube is fitted with a pump at the upper end, and is disposed through the plug that will fit in gas-tight relationship within the neck of the storage dewar. In use, the liquid cryogen is stored in the dewar with its normal, loose fitting cap that allows the gas to escape around the loose fitting cap. The liquid lies quiescently, with a minimum of boiling and gas loss. When it is desired to withdraw liquid cryogen from the storage dewar, the withdrawal device of the present invention is inserted into the neck of the dewar in gas-tight relationship, the user placing his or her hand over a hole in a bulb of the pump, creating pressure when the bulb is pumped, thereby forcing liquid upwardly through the tube and the sintered bronze filter, where it can be captured in the utilizing device or other container. The air from the pump also adds heat to the liquid, causing more boiling of $LN_2$ and increasing the pressure within the dewar. The pump typically comprises a bulb made of resilient material, having a spring disposed within it and a hole in the top allowing for control of the air flow and pressure. By adding a pump, greater control over the flow and amount of liquid withdrawn can be exercised.

The withdrawal device of the present invention will literally double the static holding time of liquid cryogen, such as nitrogen, reducing the evaporation to less than six grams per hour. Thus, use of the invention can increase the time for natural evaporation of a full dewar, such as 25 liters, to about 60 days.

Other objects, features and advantages of the present invention will become more apparent in the light of the following detailed description of exemplary embodiments thereof, as illustrated in the accompanying drawing.

BEST MODE FOR CARRYING OUT THE INVENTION

Figure 1:
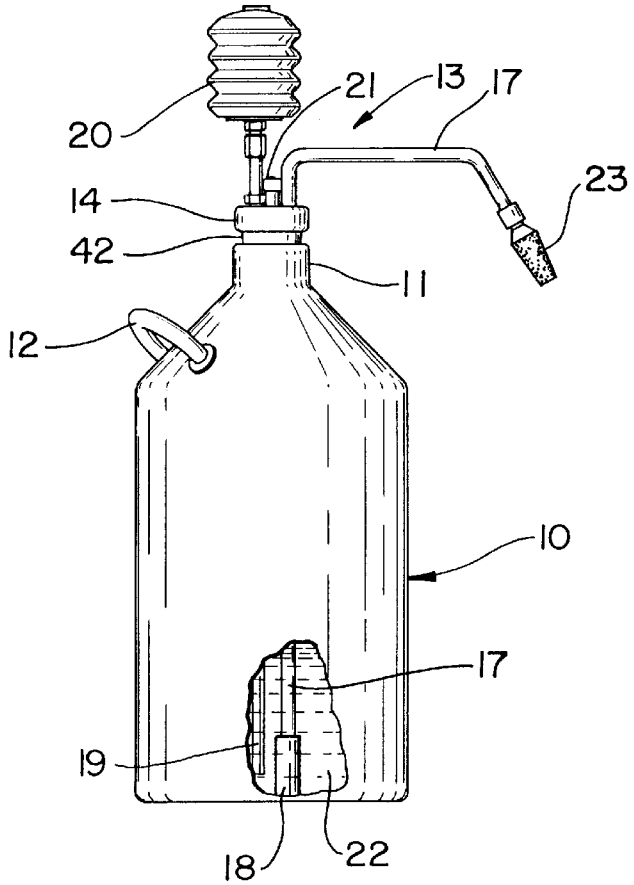
FIG. 1 is simplified side elevation view of a dewar fitted with a withdrawal device according to the present invention.

In FIG. 1, a dewar 10 typically comprises two stainless steel containers, one disposed within the other, joined at a neck section 11, with the space therebetween evacuated so as to provide superior insulation. The dewar 10 may be provided with one or more handles 12. A withdrawal device 13 of the present invention includes a plug 14 which fits in a gas-tight relationship within the opening of the neck 11. The withdrawal tube 17 extends through the plug 14 to the bottom of the interior of the dewar so as to convey liquid 22 from the dewar through the sintered bronze filter 23 and into any container which is held beneath the filter 23, such as a utilization device of the type described hereinbefore. A pressure tube 19, fitted with a pump 20, extends through the plug 14 to the bottom of the interior of the dewar. A passive heat source 18 may surround the bottom, proximal end of the withdrawal tube 17. The heat source is only present to speed up withdrawal of the liquid, but is not necessary for proper use of the present invention. The pump 20 is adequate for removing any desired amount of liquid 22 from the dewar 10. The pressure in the dewar 10 is limited by virtue of a gas pressure and relief valve 21 disposed on the plug 14 and in communication with the interior of the dewar 10.

When liquefied cryogen is being stored within the dewar 10, in accordance with the invention, the withdrawal device 13 is not installed in the dewar as shown in FIG. 1. Instead, the loosely fitting cap (not shown), which is common in the art, similar to the plug 14, provides insulation but allows the gas to freely escape. Thus, there is no heat conducted into the liquid 22 within the dewar, so the liquid boils much less than it would with the withdrawal devices known to the prior art. Therefore, the static holding time is approximately doubled.

When withdrawal of liquid from the dewar 10 is desired, the loose cap (not shown) is removed from the dewar 10, and the withdrawal device 13 is inserted therein, pressing down a little on the plug 14, so as to form a gas-tight fit at the neck 11. The liquid 22 in the dewar contacts the passive heat source 18 and withdraws heat therefrom, causing the liquid 22 to boil, creating pressure within the device. This forces liquid up through the withdrawal tube 17 and out through the sintered bronze filter 23 into whatever container is placed in proximity therewith. Because the amount of heat within the passive heat source 18 is limited, after a short period of time all the heat is removed from the passive heat source 18 and the withdrawal tube 17, so that boiling of the liquid 22 essentially ceases, and the flow of liquid in the withdrawal tube 17 slows to a trickle and essentially stops. If more liquid is needed to be withdrawn, the pump 20 is used.

Figure 2:
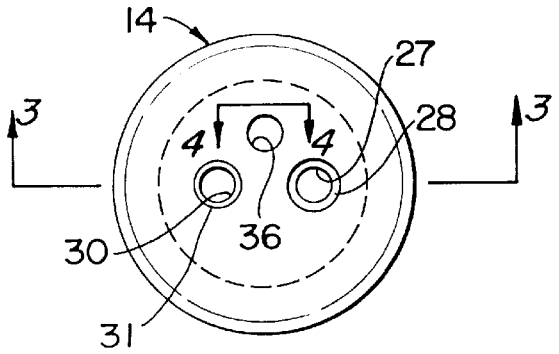
FIG. 2 is a top plan view of a plug which forms the basic structure of the withdrawal device of FIG. 1.
Figures 3, 4, 5:
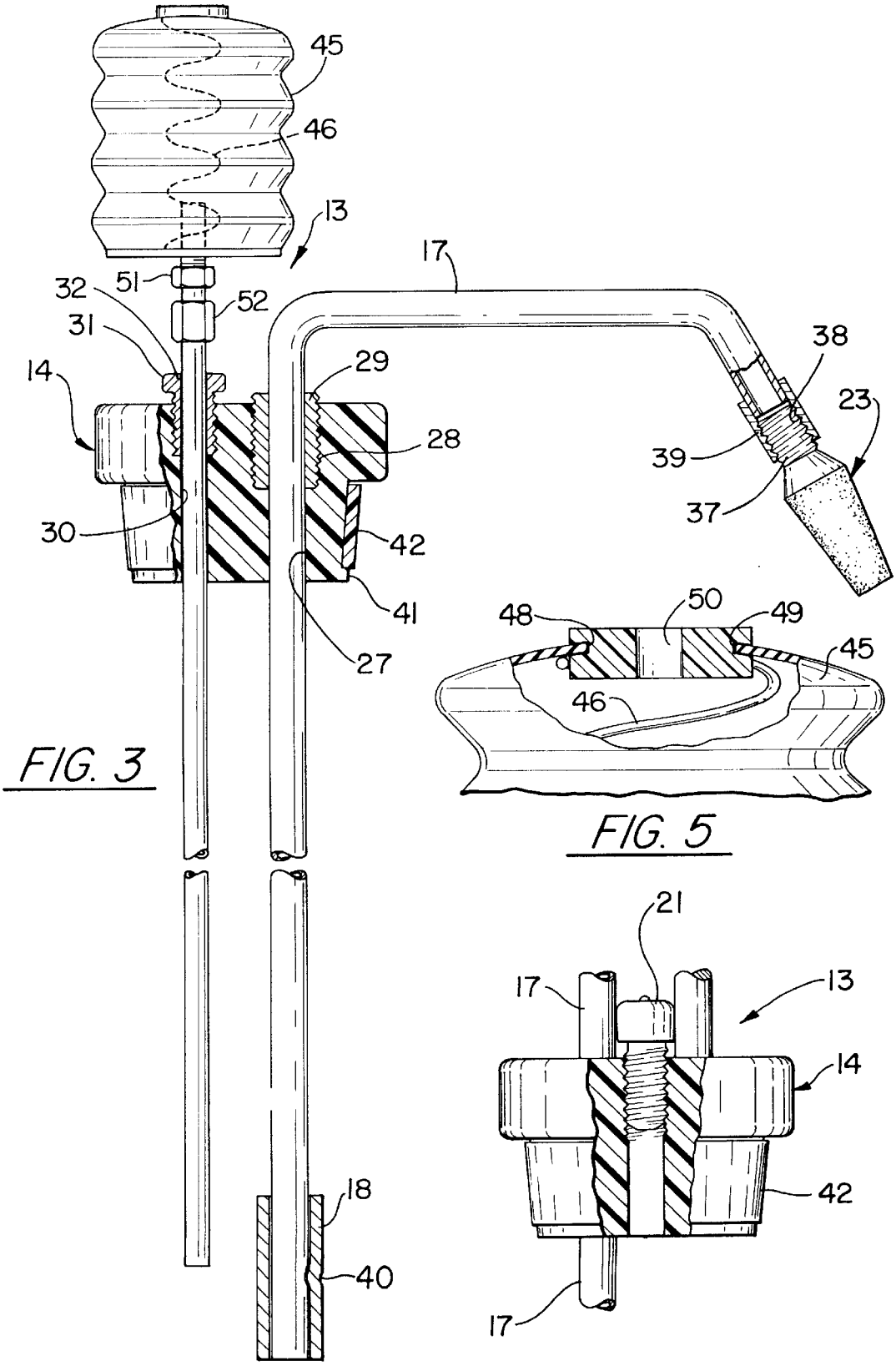
FIG. 3 is a partial, partially broke away, front elevation view, partially sectioned on the line 3—3 of FIG. 2.
FIG. 4. is a partial, rear elevation view of the plug, partially section on the line 4—4 of FIG. 2.
FIG. 5. is a partial, partially broken away and sectioned, side elevation view of the top of the pump.

Referring now to FIG. 2, the plug 14 is provided with a hole 27 having threads 28 therein. As seen in FIG. 3 the hole 27 passes entirely through the plug 14. The withdrawal tube 17 has a threaded bushing 29 disposed thereon in any suitable way; for instance, the threaded bushing 29 may be formed of brass and it may be silver soldered to the withdrawal tube 17. This threaded bushing 29 engages the teeth 28, and forms a gas seal between the plug 14 and the withdrawal tube 17.

In FIG. 2, the plug 14 is provided with a second hole 30 having threads 31 therein. As seen in FIG. 3, the hole 30 passes entirely through the plug 14. The pressure tube 19 has a threaded bushing 32 disposed thereon in any suitable way; for instance, the threaded bushing 32 may be formed of brass and it may be silver soldered to the pressure tube 19. This threaded bushing 32 engages the teeth 31, and forms a gas-tight seal between the plug 14 and the pressure tube 19.

In FIG. 2, a third hole 36 is threaded to receive the gas pressure relief valve 21, which may be any ordinary pressure relief valve having a suitable pressure rating, a number of which are readily available in the market. The pressure rating may be on the order of 2 psi or 4 psi when used with this invention. Its purpose is simply for safety, so as to avoid excess pressure buildup if for some reason the passageway through the withdrawal tube 17 and sintered bronze filter 23 became blocked.

In FIG. 3, the sintered bronze filter 23 is of a type well known in the art and readily available in the marketplace. It includes threads 37 which engage interior threads 38 and an adapter 39 which is disposed on the distal end of the withdrawal tube 17 in any suitable way, such as by being silver soldered on the end of the tube 17.

In FIG. 3, the passive heat source 18 may simply comprise a brass cylinder which fits on the withdrawal tube 17 in any fashion that will simply prevent it from falling into the dewar. In the example herewith, the passive heat source 18 catches on a flare 40 at the bottom of the withdrawal tube 17.

The plug 14 may preferably be formed of delrin. The plug 14 has a peripheral lip 41 formed therein which retains a gasket 42 which assists and making a gas-tight seal between the plug 14 and the interior of the neck 11 of the dewar 10. The gasket 42 may simply comprise a length of industrial silicone tubing, which is stretch fit over the lip 41 and which deforms into a frustoconical shape, as shown (in the nature of a cork). The silicone tubing is somewhat soft, and therefore may show wear and require replacement, but has excellent low temperature properties, and will not become brittle.

In FIG. 3, the pressure tube 19 contains a check valve 52, joined to the tube 19 by a compression fitting 51, to assure that air is let into the dewar 10, but cannot come out, thereby retaining pressure.

In FIG. 5, the pressure tube 19 is fitted with a pump 20, comprised of a resilient bulb 45, which has a spring 46 disposed within the bulb. There is a hole 48 in the top of the bulb, which is fitted with a plug 49, which contains a smaller hole 50. This smaller hole 50 is covered by the user's hand, and thus pressure is created when the pump is pushed up and down. The air added to the dewar also adds heat to the $LN_2$, causing it to boil, which also increases the pressure inside the dewar forcing the liquid to travel up the withdrawal tube 17. If the bulb 45 is sufficiently resilient, the spring 46 may be omitted.

All of the aforementioned patent applications are incorporated herein by reference.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

I claim:

1. A device for withdrawing liquid cryogen from a dewar, such as for transferring liquid cryogen from the dewar to a container, comprising:

a plug sized to provide a tight fit within the neck opening of a liquid cryogen dewar;

a withdrawal tube passing through said plug and secured thereto with a gas-tight fit, said tube being of a length to reach substantially the bottom of a dewar with which said withdrawal device is to be used so as to receive liquid at a proximal end thereof, said tube extending outwardly from said plug so as to permit liquid flow from a distal end thereof into said container; and a pressure tube passing through said plug and secured thereto with a gas-tight fit, said tube extending upwardly from said plug, and fitted with an air pump by which pressure may be created in the dewar to force the liquid out, said pump including a bulb disposed on said pressure tube in a manner to serve as a handle to facilitate insertion of said withdrawal device into a dewar and removal of said withdrawal device from said dewar.

2. A withdrawal device according to claim 1 wherein said pressure tube is of length to reach substantially the bottom of a dewar.

3. A withdrawal device according to claim 1 wherein said pump comprises:

a bulb made of resilient material and having a hole which can be blocked by the user's hand so as to create pressure when pumped by collapsing said bulb; and a spring disposed within the bulb.

4. A withdrawal device according to claim 3 wherein said bulb is a bellows.

5. A withdrawal device according to claim 3 wherein said bulb has a compression spring therein exerting pressure between upper and lower walls thereof to assure that said bulb is restored to an uncollapsed condition between strokes.

6. A withdrawal device according to claim 3 including a gas pressure relief valve disposed in a hole through said plug so as to be in gaseous communication with the interior of said dewar when said withdrawal device is in use.

7. A withdrawal device according to claim 1 including a sintered bronze filter disposed at the distal end of said withdrawal tube.

8. A method of storing liquid nitrogen in a dewar and removing liquid nitrogen from said dewar using the device of claim 1, comprising:

storing liquid cryogen in said dewar with a loose fitting cap inserted in the neck opening of said dewar and with no part of any fixture immersed in said liquid cryogen;

removing said loose fitting cap from the neck opening of said dewar and inserting said device in said neck opening;

adding additional pressure as needed by operating said pump until sufficient pressure has been created to withdraw an amount of liquid needed;

removing said withdrawal device from said neck opening; and restoring said loose fitting cap into said neck opening.

9. A method of storing liquid nitrogen in a dewar and removing liquid nitrogen from said dewar, comprising:

storing liquid cryogen in said dewar with a loose fitting cap inserted in the neck opening of said dewar and with no part of any fixture immersed in said liquid cryogen;

removing said loose fitting cap from the neck opening of said dewar and inserting in said neck opening a liquid cryogen withdrawal device having a plug sized to provide a gas-tight fit seated within said neck opening, a withdrawal tube extending through said plug with a gas-tight fit to substantially the bottom of said dewar so as to receive liquid cryogen at its proximal end, and a pressure tube extending through said plug and having an air pump disposed thereon for causing gas pressure to build up within said dewar thereby forcing liquid into the proximal end of said withdrawal tube, and conducting said liquid from said dewar;

adding additional pressure as needed by operating said pump until sufficient pressure has been created to withdraw an amount of liquid needed;

removing said withdrawal device from said neck opening; and restoring said loose fitting cap into said neck opening.

* * * * *